US009835375B2

(12) United States Patent
Bloemendaal

(10) Patent No.: US 9,835,375 B2
(45) Date of Patent: Dec. 5, 2017

(54) HYBRID CONTINUOUS FLOW GRAIN DRYER

(71) Applicant: CTB, Inc., Milford, IN (US)

(72) Inventor: Brent J. Bloemendaal, Zionsville, IN (US)

(73) Assignee: CTB, INC., Milford, IN (US)

( * ) Notice: Subject to any disclaimer, the term of this patent is extended or adjusted under 35 U.S.C. 154(b) by 448 days.

(21) Appl. No.: 14/179,870

(22) Filed: Feb. 13, 2014

(65) Prior Publication Data

US 2015/0226482 A1 Aug. 13, 2015

(51) Int. Cl.
*F26B 17/12* (2006.01)
*F26B 17/14* (2006.01)

(52) U.S. Cl.
CPC ..... *F26B 17/12* (2013.01); *F26B 17/126* (2013.01); *F26B 17/128* (2013.01); *F26B 17/145* (2013.01); *F26B 2200/06* (2013.01)

(58) Field of Classification Search
CPC ..... F26B 17/126; F26B 17/12; F26B 17/122; F26B 17/1416; F26B 17/1408; F26B 17/14; F26B 17/1458; F26B 17/1433
See application file for complete search history.

(56) References Cited

U.S. PATENT DOCUMENTS 731,682 A * 6/1903 Hillig ..... F26B 17/1416 34/170
2,434,202 A 1/1948 Evans et al.
3,238,637 A 3/1966 Mark et al.
3,629,954 A 12/1971 Lavalier
4,149,844 A 4/1979 Noyes
4,152,841 A 5/1979 Westelaken
(Continued)

FOREIGN PATENT DOCUMENTS

GB 240533 A 10/1925
SU 635382 11/1978
(Continued)

OTHER PUBLICATIONS

Bakker-Arkema et. al, Analysis of Continuous-flow Grain Dryers, Grain drying in Asia: Proceedings of an International Conference held at the FAO Regional Office for Asia and the Pacific, Bangkok, Thailand, Oct. 1995.*
Cimbria Continuous Flow Dryer; Cimbria Company Brochure, retrieved from http://almondbg.eu/images/Continuous_Flow_Dryer_brochure_GB.pdf prior to Feb. 13, 2014.
(Continued)

*Primary Examiner* — Jason Lau
(74) *Attorney, Agent, or Firm* — Harness Dickey

(57) ABSTRACT

Grain flow paths have an upper portion which is a mixed flow portion and which includes a preheat zone and a lower portion which is an undulating moisture equalizer portion and which includes a heat zone. Mixed flow grain diverters extend across the grain flow path substantially perpendicular to longitudinal side walls, and substantially parallel to transverse end walls of the grain flow path. Upper airflow openings are associated with each of the upper diverters. Moisture equalizer lower grain diverters extend along the longitudinal sides grain flow path substantially parallel to the longitudinal side walls, and substantially perpendicular to the transverse end walls of the grain flow path. The burner is positioned outside the airflow path to feed ambient air into the recirculating airflow path, without recirculating airflow passing through the burner.

16 Claims, 7 Drawing Sheets

(56) References Cited

U.S. PATENT DOCUMENTS

| | | | | |
|---|---|---|---|---|
| 4,249,891 | A | 2/1981 | Noyes et al. | |
| 4,268,971 | A | 5/1981 | Noyes et al. | |
| 4,404,756 | A | 9/1983 | Noyes | |
| 4,424,634 | A | 1/1984 | Westelaken | |
| 4,486,960 | A | 12/1984 | Maurice et al. | |
| 4,914,834 | A | 4/1990 | Sime | |
| 5,467,535 | A | 11/1995 | Lentz | |
| 6,122,838 | A | 9/2000 | Bloemendaal | |
| 6,158,143 | A | 12/2000 | Da Cunha | |
| 6,209,223 | B1 | 4/2001 | Dinh | |
| 6,834,442 | B1 | 12/2004 | Bloemendaal | |
| 6,834,443 | B2 | 12/2004 | Bloemendaal | |
| 2013/0014404 | A1* | 1/2013 | Bloemendaal | F26B 17/126 34/167 |

FOREIGN PATENT DOCUMENTS

| | | |
|---|---|---|
| SU | 1267144 | 10/1986 |
| SU | 1285284 | 1/1987 |

OTHER PUBLICATIONS

Grain Handler Continuous Mixed Flow Dryers, Fan Under Series; Grain Handler Company Brochure, retrieved from http://www.grainhandler.com/GrainHandlerBrochure.pdf prior to Feb. 13, 2014.

NECO Continuous-Flow Grain Dryers; NECO Company Brochure, retrieved from http://www.alliedgrainsystems.com.au/f.ashx/12A-NecoDryersPamphlet.pdf prior to Feb. 13, 2014.

Russian Patent Office International Search Report acting on behalf of the Turkish Patent Office dated Feb. 21, 2014 for Turkish Patent Application No. TR2012/03897.

Columbian Patent Office Examiner Report dated May 6, 2014 for Columbian Patent Application No. 12069537 (with English summary).

Perfless Sales Presentation, CTB/Brock Grain Systems, May 11, 2011.

Brock Perfless Grain Drying System Brochure, CTB/Brock Grain Systems, Aug. 25, 2011.

International Search Report and Written Opinion dated Apr. 28, 2015 in corresponding Application No. PCT/US2015/014776.

* cited by examiner

HYBRID CONTINUOUS FLOW GRAIN DRYER

FIELD

The present disclosure relates to continuous flow grain dryers.

BACKGROUND

This section provides background information related to the present disclosure which is not necessarily prior art.

Continuous flow grain dryers, such as those shown in U.S. Pat. Nos. 4,404,756, 4,268,971, and 5,467,535, which are incorporated herein by reference in their entirety, generally include two continuously moving columns of grain. One type of continuous flow grain dryer is known in the industry as a "mixed flow" grain dryer. Such grain dryers are commercially available from companies such as Cimbria, NECO, and Grain Handler USA. Other types of continuous flow grain dryers are also available. Each type of grain dryer has its own advantages and disadvantages.

For example, in most types of continuous flow grain dryers air discharged from a fan typically next passes through a burner and then through a grain column only once before being discharged or returned to the blower for recirculation. Recirculated air from volatile grains presents a risk of fire, since it typically needs to pass through the heater during the recirculation process where fines can be ignited. Such single pass airflow through the grain column, and such limitations on the ability to recirculate the air limits the efficiency of the grain drying operation.

One way to attempt to increase efficiency is to cause the heated air to pass through the grain column multiple times. Sometimes this can create challenges for dealing with grain fines within the grain column. For example, some continuous flow grain dryer types might tend to cause the fines to move to a particular position in the grain column (e.g., the edges). Some continuous flow grain dryer types might also recirculate the heated air into grain when the grain has not yet been sufficiently heated to minimize condensation on the grain kernel, which can cause fines to clump, or to stick to the grain dryer walls or diverters.

SUMMARY

This section provides a general summary of the disclosure, and is not a comprehensive disclosure of its full scope or all of its features.

In one aspect of the disclosure a hybrid continuous flow grain dryer includes a pair of grain flow paths through which the grain flows downwardly under the influence of gravity in a grain column. Each grain flow path is defined by a pair of longitudinally extending side walls and a pair of transversely extending end walls. Each grain flow path has an upper portion including a plurality of upper elongated grain diverters extending transversely across the grain flow path between opposing inner faces of the pair of longitudinally extending side walls. The upper portion also includes an upper opening in the side walls associated with each upper grain diverter. Each grain flow path also has a lower portion including a plurality of lower elongated grain diverters extending longitudinally along alternating sides of the grain flow path between opposing inner faces of the pair of end walls. The lower portion also includes a longitudinally extending lower opening in the side walls associated with each lower grain diverter.

In another aspect of the disclosure a hybrid continuous flow grain dryer includes a pair of grain flow paths through which the grain flows downwardly under the influence of gravity in a grain column. Each grain flow path is defined by a pair of longitudinally extending side walls and a pair of transversely extending end walls. Each grain flow path has an upper portion including a plurality of upper elongated grain diverters extending transversely across the grain flow path between opposing inner faces of the pair of longitudinally extending side walls. The upper portion also includes an upper opening in the side walls associated with each upper grain diverter. Each grain flow path also has a lower portion including a plurality of lower elongated grain diverters extending longitudinally along alternating sides of the grain flow path between opposing inner faces of the pair of end walls. The lower portion also includes a longitudinally extending lower opening in the side walls associated with each lower grain diverter. In this aspect the upper elongated grain diverters are aligned substantially perpendicular in plan view to the longitudinally extending side walls, and the lower elongated grain diverters are aligned substantially parallel in plan view to the longitudinally extending side walls.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of one exemplary embodiment and not all possible implementations, and are not intended to limit the scope of the present disclosure.

Figure 1:
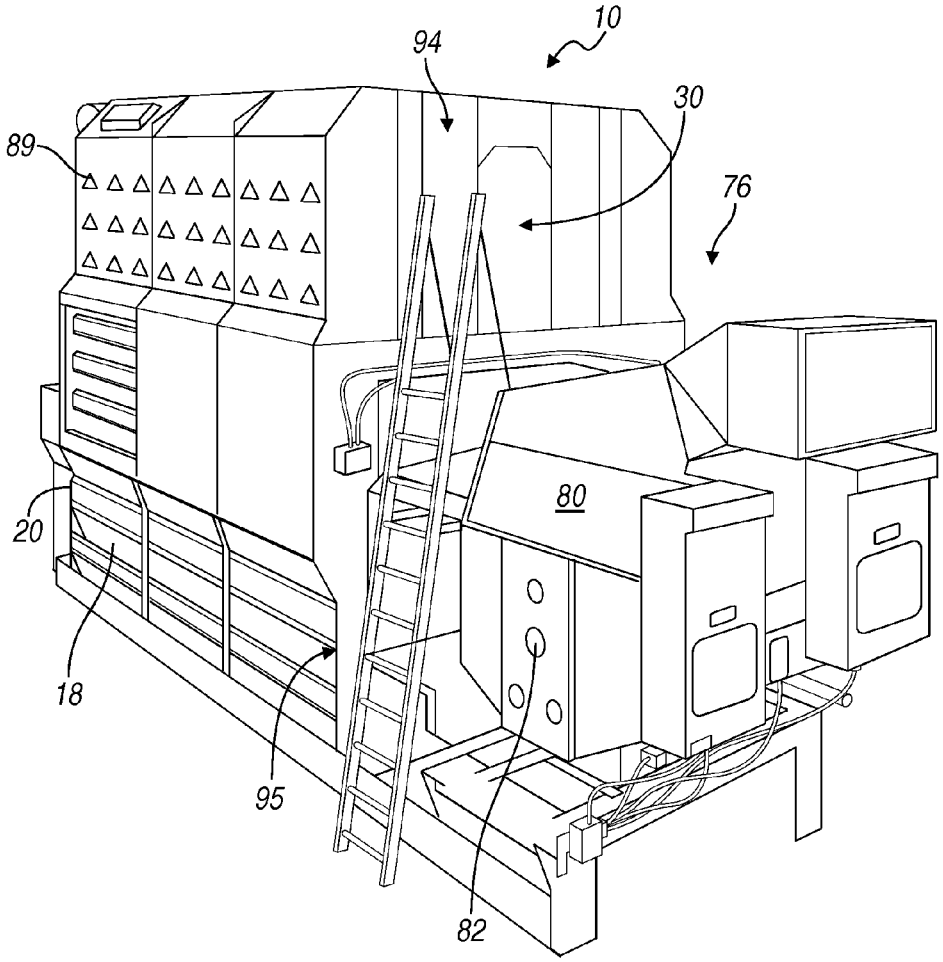
FIG. 1 is a perspective view of one exemplary grain dryer in accordance with the present disclosure.
Figure 7:
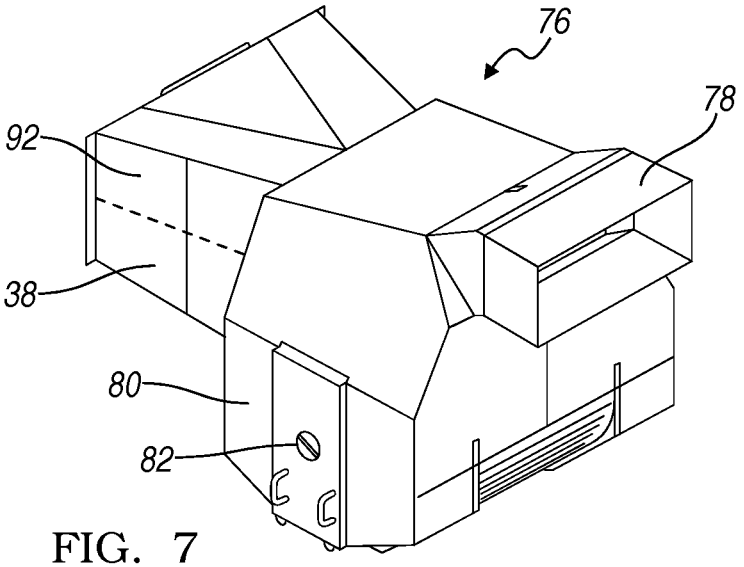
Figure 8:
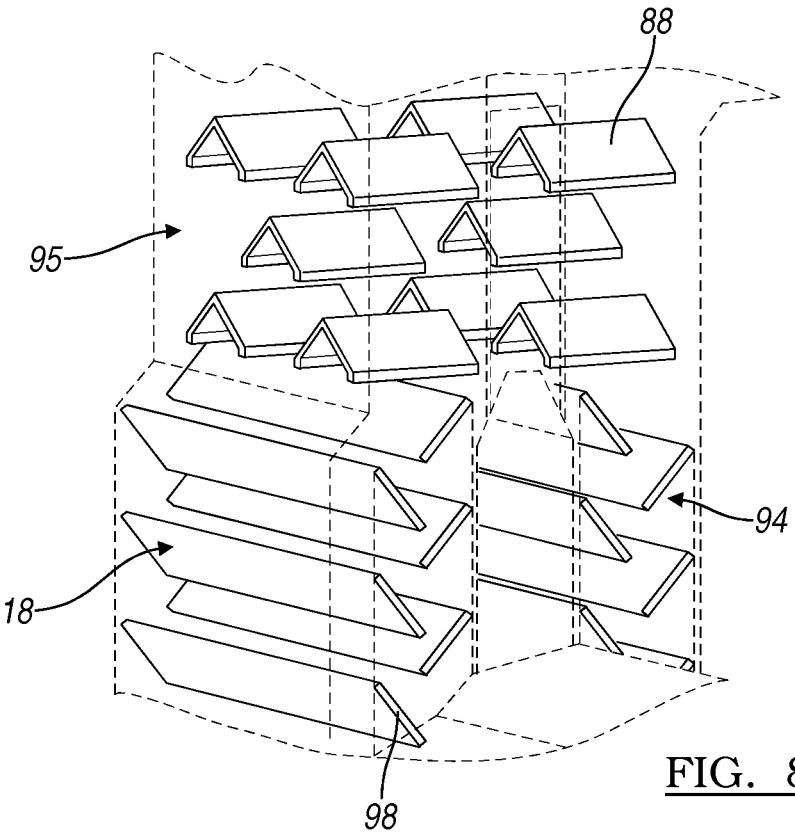
Figure 9:
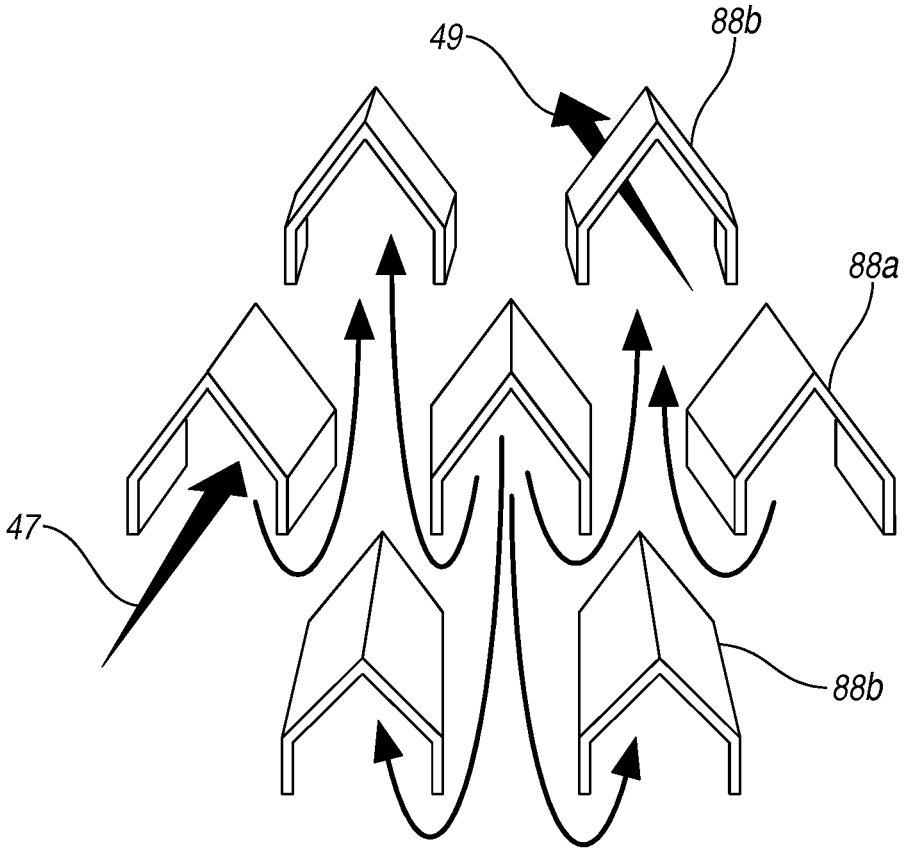

FIG. 7 is a perspective view showing an outer shroud of the fan of the exemplary grain dryer of FIG. 1; and FIG. 8 is a partial perspective view illustrating the alignment of the upper diverters relative to the lower diverters (substantially perpendicular to each other) and relative to the longitudinal side walls and transverse end walls; and FIG. 9 is a perspective view showing the airflow into, thru, and out of the grain column in an upper portion of the grain flow path.

Corresponding reference numerals indicate corresponding parts throughout the several views of the drawings.

DETAILED DESCRIPTION

Example embodiments will now be described more fully with reference to the accompanying drawings.

Figure 2:
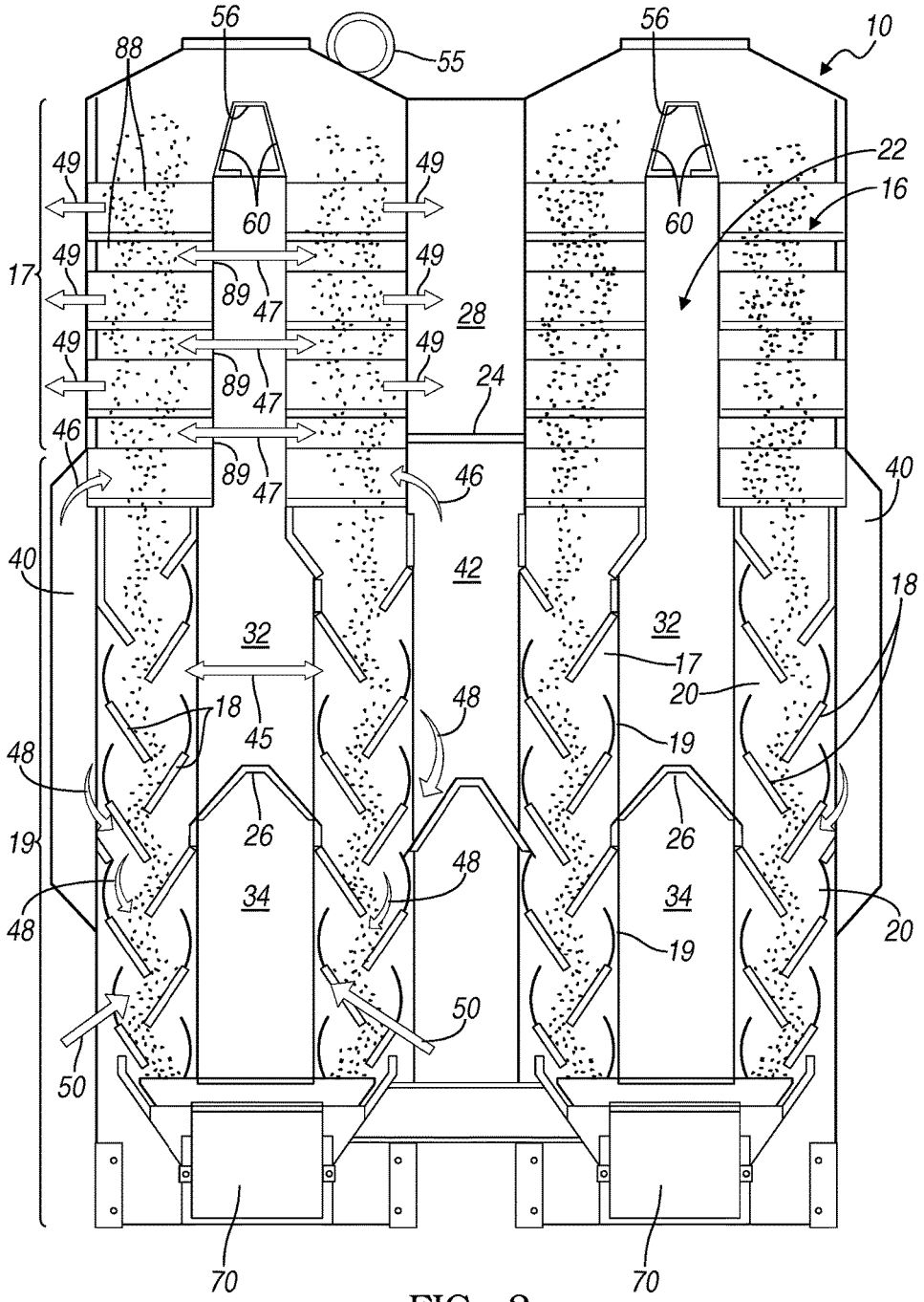
FIG. 2 is a simplified cross-sectional view showing the grain flow paths and certain airflow paths within the exemplary grain dryer of FIG. 1.
Figure 3:
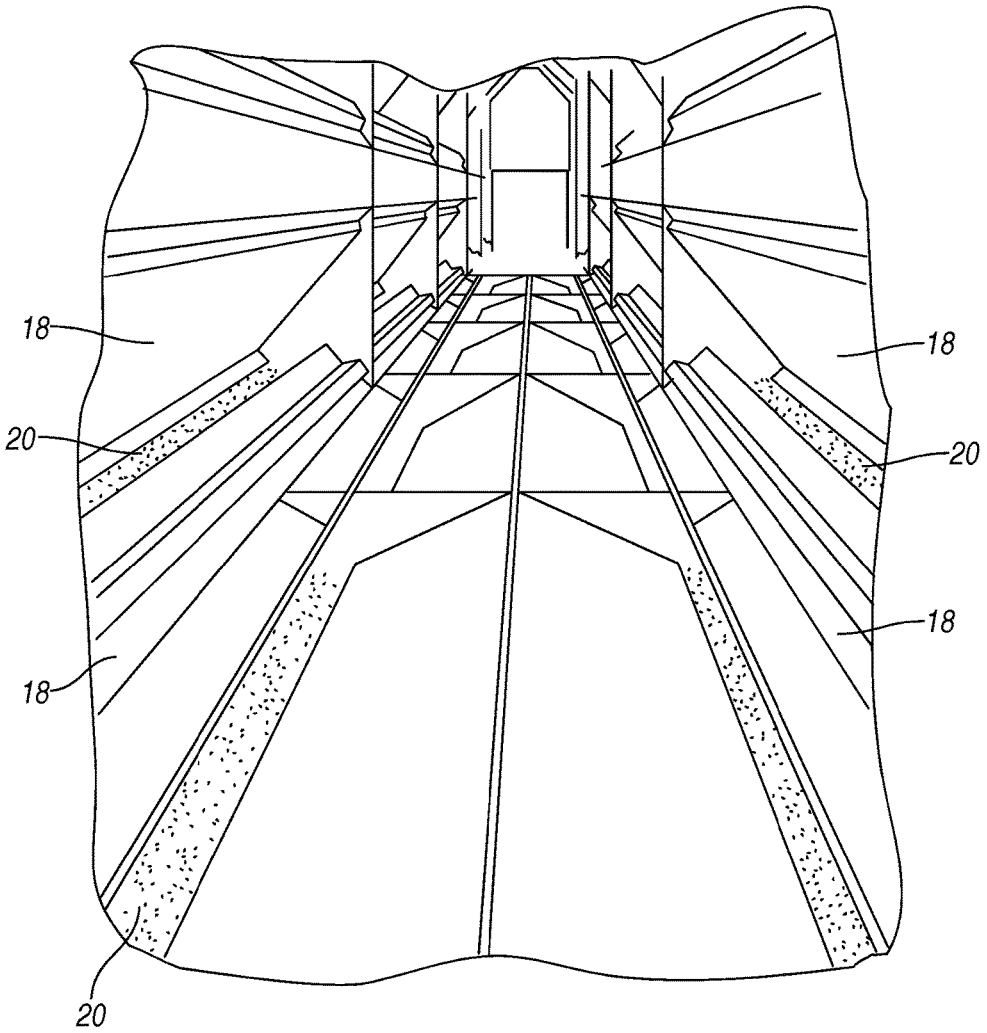
FIG. 3 is an internal view of one of the sub-plenums and showing the elongated airflow openings defined by the panels of the exemplary grain dryer of FIG. 1.

Referring to FIGS. 1 through 9, an exemplary embodiment of a continuous flow grain dryer 10 of the present disclosure can generally include an induced draft burner 12 (FIG. 6), and a double wide, double inlet centrifugal fan 14 (FIG. 6) providing double pass airflow through a plurality of grain columns within grain flow paths 16 (FIG. 2).

The illustrated embodiment includes four adjacent grain flow paths 16 that define four grain columns in use. In this exemplary embodiment, the adjacent grain flow paths 16 are longitudinally extending and therefore are completely separate from each other. Each grain flow path 16 is defined by a pair of longitudinally extending side walls 95 and a pair of end walls 94. Adjacent grain flow paths 16, however, can also exist in a circular grain dryer wherein opposing portions of a circular grain column can be considered to form adjacent grain flow paths 16.

An upper portion of each grain flow path 16 includes a plurality of upper elongated grain diverters 88 extending transversely across the grain flow path 16. These upper transverse grain diverters 88 can extend substantially perpendicular to the side walls 95 in a side (or elevation) view, or in a top (or plan) view, or in both side and plan views. These upper grain diverters 88 can have a generally inverted "V" or "U" shaped configuration and can be coupled to opposing side walls 95 at their opposing ends.

These upper transverse grain diverters 88 can be arranged in a plurality of substantially horizontal rows. The transverse diverters 88 of each horizontal row can be offset from each other by fifty percent. In other words, the transverse diverters 88 in alternating horizontal rows can be vertically aligned and the transverse diverters 88 of adjacent horizontal rows can be aligned along a plane that is angled to a horizontal plane as seen in FIGS. 8 and 9.

A generally triangular opening 89 in a side wall 95 can be associated with one end of each of the transverse diverters 88. Specifically, the grain diverters 88 in one horizontal row can be coupled to a side wall 95 to surround the upper portion of a triangular opening 89 in the side wall 95 defining a grain flow path 16. The upper transverse grain diverters 88 in adjacent horizontal rows can be coupled to the opposite side wall 95 defining the same grain flow path 16 to surround the upper portion of a triangular opening 89 in the opposite side wall 95.

Such a configuration can create an airflow path through a grain column in the grain flow path 16 as illustrated in FIG. 9. It should be appreciated from FIG. 9 that the air flows into the grain column through an inlet opening 89 in one side wall 95 at one transverse diverter 88 as indicated by arrow 47 and then can exit through an outlet opening 89 in the opposite side wall 95 associated with or at a different diverter 88 as indicated by arrow 49. In addition, the inlet openings 89 can be provided at first alternating horizontal rows of transverse diverters 88*a*, while the exit openings 89 can be provided at second alternating rows of the transverse diverters 88*b* interspersed therebetween. Although FIG. 9 has been simplified to show only three rows of diverters, six or seven, or a different plurality of rows of diverters 88 and openings 89 can be provided.

Not only can this upper portion 17 of the grain flow paths 16 have the transverse diverters 88, but the upper portion 17 can also have a relatively large cross-sectional area relative to the lower portion 19 (detailed hereinafter) of the grain flow paths 16. This additional cross-sectional area can be provided by providing a larger transverse distance between the opposing side walls 95 defining each grain flow path 16 in the upper portion 17, than in the lower portion 19. This can enable a larger volume of grain to be resident in the upper portion 17 of the grain column 16 than in the lower portion 19. The relatively larger cross sectional area of width can also enable a larger residence time per vertical foot of movement for the grain in the upper portion 17 of the grain column 16 than in the lower portion 19.

In the lower portion 19 of each grain flow path 16 each of the grain columns can result from an undulating grain flow path 16. The grain flow path 16 is defined by opposing sets of a plurality of longitudinally extending panels 18. The longitudinally extending panels 18 have a lower portion that is angled transversely downwardly and toward the center of the grain flow path 16 to provide lower elongated grain diverters 98, which act as moisture equalizers.

The lower grain diverters 98 extend longitudinally along alternating sides of the grain flow path 16 or grain column between the opposing pair of end walls that define the grain flow path 16. The lower grain diverters 18 can extend longitudinally in a direction substantially parallel to the side walls 95 in a top (or plan) view. Thus, the lower grain diverters 18 can extend longitudinally in a direction that is substantially perpendicular to the longitudinal direction of the upper grain diverters 88 in top (or plan) view, or in side (or elevation) view, or in both side and plan views.

As should be apparent from the above description, the upper grain diverters 88 can tend to distribute grain fines along transverse lines extending the width of the upper portion 17 of the grain column, or substantially perpendicular to the side walls 95. In contrast, the lower grain diverters 98 can tend to distribute grain fines along longitudinal lines substantially parallel to the side walls 95. As a result, the grain fines can remain more evenly distributed throughout the grain column as the grain flows from the top of the grain flow path 16 to its bottom.

The angled panels 18 of each opposing side wall 95 are vertically spaced apart from each other forming upwardly facing elongated openings 20 (seen best in FIG. 3 with grain present) between vertically adjacent panels 18. Elongated openings 20 allow airflow to pass through one lateral side wall 95 of each grain flow path 16 between panels 18, through centrally located undulating grain flow path 16, and out of the grain flow path 16 through elongated openings 20 of the opposing lateral side wall 95.

A central air plenum 22 is located in the space between a pair of grain flow paths 16 (a first and second grain flow path 16) on the left in FIG. 2. An additional central air plenum 22 is positioned in the space between another pair (a third and fourth grain flow path 16) on the right in FIG. 2. The sides of each central air plenum 22 are laterally defined by inner side walls 95 of adjacent grain flow paths 16 in the pair.

Each central air plenum 22 can include a divider 26 separating central plenum 22 into two sub-plenums. The upper sub-plenum can be a heat plenum 32. The high pressure (or positive pressure), high heat airflow from fan 14 first flows into heat plenum 32 of central plenum 22. Sub-plenum below heat plenum 32 can be a return plenum 34. Air which has passed through a grain column in one of the grain flow paths 16 can be pulled from return plenum 34 to an inlet 36 of fan 14 via a return flow air duct 38. Thus, the pressure in return plenum 34 can be below atmospheric pressure (negative pressure) during operation.

Figure 6:
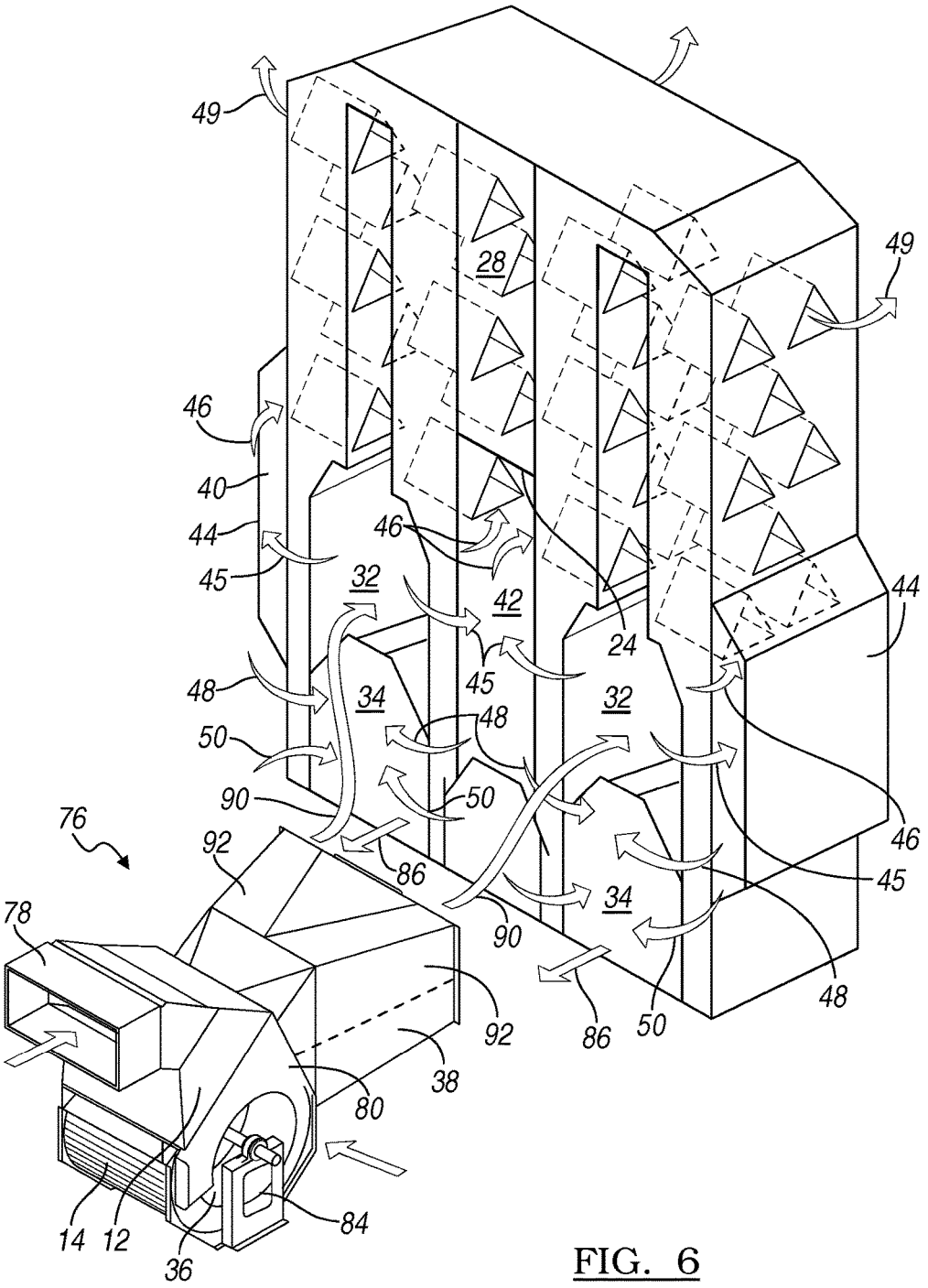
FIG. 6 is a simplified perspective view illustrating various airflow paths of the exemplary grain dryer of FIG. 1.

Enclosures 40, 42 are provided on sides of the grain flow paths 16 opposite that defining central plenum 22. Outer enclosures 40 on opposing sides of the four grain columns can be defined by outer walls 44 (FIG. 6). Inner enclosure 42 can be provided in the space between the pairs of grain flow paths 16 (between second and third grain flow paths 16 in this example). Sides of inner enclosure 42 are partially defined by sets of panels 18 forming the side wall 95 opposite those forming the sides walls 95 of the central plenum 22.

Enclosures 40, 42 are positioned laterally adjacent a portion of high pressure, high heat plenum 32 to capture airflow passing through the lower portion of adjacent grain flow path 16 from heat plenum 32 via high heat airflow path represented by two-headed arrow 45. Enclosures 40, 42 additionally define a portion of an airflow path represented by arrows 46 that once again passes through an adjacent grain flow path 16 before being ultimately exhausted to the atmosphere from the grain dryer 10.

Enclosures 40, 42 further define a portion of a temper airflow path represented by arrows 48 that once again passes through an adjacent grain flow path 16 and into return plenum 34. Thus, air entering central plenum 22 and passing through the grain flow path into one of the enclosures 40 and 42 makes two passes through a grain flow path 16 prior to (1) exiting to the atmosphere, or (2) returning via return plenum 34 to fan 14 via return duct 38 for recirculation.

Air also enters the grain columns from each heat plenum 32 at the upper portion of the grain flow paths 16 via the triangular inlet openings 89 of the side walls 95 defining the high pressure (or positive pressure), heat plenum 32 as indicated by double-headed arrows 47. The air flows into the channel created below the associated generally triangular diverter 88. The air then flows through the grain column as seen in FIG. 9, and then out a triangular outlet opening 89 of the opposing side wall 95 defining the grain flow path 16. The air exiting of the upper portion 17 through the upper triangular outlet openings 89 is exhausted to the atmosphere directly or via exhaust plenum 28 between the pairs of grain columns above divider 24 defining enclosure 42. This central exhaust plenum 28 is open to the atmosphere via openings 30 in the end walls 94 as best seen in FIG. 1. This provides a pre-heat zone in the upper portion 17 of the grain column as described hereinafter.

Figure 4:
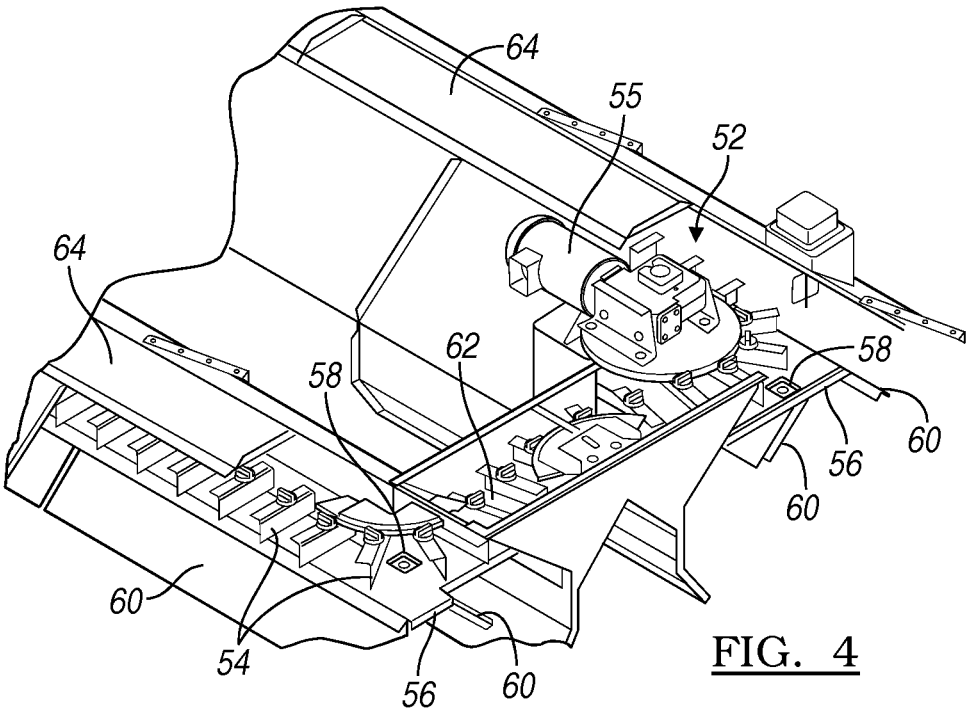
FIG. 4 illustrates a loop paddle conveyor which can be used to feed grain into the top of the grain flow paths in exemplary grain dryer of FIG. 1.

Referring to FIG. 4, a loop drag input conveyor 52 including grain paddles 54 can be provided. A motor 55 drives loop drag input conveyor 52. Paddles 54 are positioned in a loop above two upper shelves 56 extending the length of the grain flow paths 16. Each shelf 52 can include periodic openings 58 allowing grain to fall through the shelf 52. Additionally or alternatively, each shelf 52 can include downwardly angled walls 60 along each side of shelves 52 or below openings 58, with each angled wall 60 extending downwardly toward the top of one of the grain flow paths 16. Thus, each downwardly angled wall 60 can be configured to direct grain from shelves 52 (e.g., over a side or through an opening 58) into the top of one of the grain flow paths 16. A connecting shelf 62 can connect the two upper shelves together at each end of grain dryer 10 to complete the loop arrangement of drag conveyor 52.

A cover can be provided over loop drag conveyor 52, which includes a plurality of panels 64. The loop arrangement of drag conveyor 52 allows grain to be added to the continuous flow dryer 10 at essentially any point along the loop. For example, any cover panel 64 can simply be removed to create a grain input opening to feed grain to loop drag conveyer 52 by which the pairs of grain flow paths 16 are fed. Alternatively, a cover panel 64 including a grain input opening therethrough (not shown) can simply be placed at any point along the loop to feed conveyor 52. Thus, a grain input opening can be located at either end of grain dryer 10, or at any point along either lateral side of grain dryer 10. It can be desirable in some instances to dispose motor 55 opposite in the loop from the location of the grain input. For example, the both motor 55 and the grain input can be on opposite sides at one end of the grain dryer, so that the inputted grain flows along a "U" shape path prior to encountering motor 55 coupled to the paddle drive.

Referring to FIG. 2, shelves 56 and downwardly angled walls 60 by which grain flows into grain flow paths 16 can be seen. This allows grain to flow into each of the grain flow paths 16 between pairs of longitudinally extending side walls 95 of the upper portion 17. The longitudinally extending side walls 95 of the upper portion 17 can be formed by a plurality of panels with openings 89 aligned in horizontal rows as previously described. Also as previously described, the upper portion 17 can have a larger cross-sectional area relative to the lower portion 19 of the grain flow column.

Opposing panels 18 forming side walls 95 and grain flow paths 16 can have a smaller width or cross-sectional area lower portion 19 below the upper portion 17 and adjacent return plenum 34 and the heat plenum 32. In lower portion 19 of the grain flow path 16 the lateral spacing between opposing panels 18 forming each grain flow path 16 can be constant. In addition, the lower end of each panel 18 on one side can be vertically aligned with the lower end of opposing panels 18. Thus, the fact that angled panels 18 define undulating grain flow paths 16 defining a grain column can be understood.

Horizontally extending elongated airflow openings 20 can also be defined by spaces between vertically adjacent panels 18 on each side of grain flow paths 16. These airflow openings 20 between vertically adjacent panels 18 are present on opposing sides of each grain flow path 16. Openings 20 enable airflow through one side of the grain flow path 16, through a grain column in the path 16, and out through opposing openings 20 of the other lateral side of the grain flow path 16. The relationship between the airflow flowing through a grain column in to and out of various plenums of central plenum 22 is affected by the width of elongated openings 20 created by the spacing between vertically adjacent panels 18. The width of openings 20 can also be sufficiently large that the exiting airflow speed through openings 20 is below that which lifts grain out of grain flow path 16 through openings 20. Thus, there is no need for any screens on the openings 20, despite the fact that the width of openings 20 is larger than the diameter of grain in grain flow path 16. The width of openings 20 can be many times larger than the average diameter of the grain. For example, the width in some cases can be at least about 25 mm, at least about 50 mm, at least about 75 mm, or at least about 100 mm.

The divider 26 can also affect the relationship between the airflow flowing through grain columns in grain flow paths 16 into and out of the central plenum 22. For example, the divider 26 can be coupled to one of angled panels 18 defining inner (or opposing) walls of adjacent grain flow paths 16. This helps avoid any airflow path around dividers 24, 26 this is undesirably shortened, resulting in an undesirable short circuit of the airflow from heat plenum 32 to an adjacent part of central plenum 22. The width of elongated openings 20 can also be varied in order to aid in reducing undesirably shortened airflow paths. Differences in the widths of various elongated openings at various locations along grain flow paths 16 can be seen in the drawings. Thus, in some instances the width (or height) of openings 20 might vary between 20 mm and 100 mm at various locations along grain flow paths 16.

In addition, divider 26 can have a sloped or convex upper central surface and can be attached at an upper end of an angled panel 18 on each side. Thus, any grain that might possibly fall from one of elongated openings 20 will fall onto the sloped or convex upper surface of the divider 26, which will guide the grain back into an adjacent grain flow path 16 via an adjacent elongated opening 20.

Figure 5:
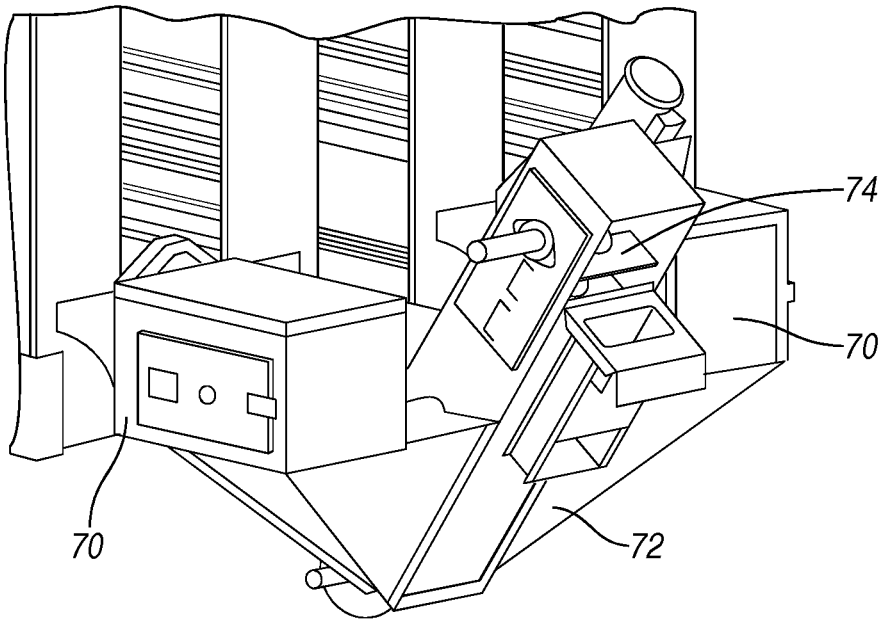
FIG. 5 illustrates a jump drag conveyor by which the output from each metering paddle conveyor can be joined to a single grain output in the exemplary grain dryer of FIG. 1.

Referring to FIGS. 2 and 5, an output metering drag conveyor 70 can be provided at the bottom of each pair of grain flow paths 16. An exemplary metering drag conveyor 70 which can be used is described in detail in U.S. Pat. No. 6,834,442, incorporated herein, in its entirety, by reference. An terminal end of each output metering drag conveyor 70 can include an output that feeds a jump drag mechanism 72 that can joins the outputs of both metering drag conveyors 70 into a single grain output collection point. From there a discharge drag conveyor 74 or auger conveyor can be used to discharge the conditioned grain from the grain dryer 10.

Referring to FIGS. 1, 6 and 7, a combined fan and burner assembly 76 can be positioned at one end of grain dryer 10. Assembly 76 can include induced draft burner 12 positioned between an air intake 78 and centrifugal fan 14. Thus, fan 14 pulls airflow through air intake 78 and into fan 14 through a fan inlet 36. Fan 14 can be a double wheel, double intake centrifugal fan wherein there is a central fan intake 36 on each side of the fan 14. A variable frequency drive motor (not shown) can drive fan 14 at variable speeds.

A shroud 80 on each side of assembly 76 provides airflow ducting from burner 12 to inlet 36 of fan 14. Each shroud 80 also provides a portion of return airflow duct 38 for airflow coming from return plenum 34 to inlets 36 of fan 14. Shroud 80 can include an outer member with a central opening 82 (FIG. 7) adjacent the fan wheel bearings 84 (FIG. 6). Central opening 82 in shroud 80 allows unheated air to flow over bearings 84 to cool them. This can greatly reduce negative effects on bearings 82 that might otherwise result from providing burner 12 immediately upstream from fan 14.

Referring to FIG. 6, ambient air enters burner 12 via air inlet 78. Air exiting burner 12 flows into inlets 36 at each side of fan 14. The air is directed via shroud 80, which defines an air duct between burner 12 and inlet 36 on each side of fan 14. Thus, a burner airflow path flows through air inlet 78 to burner 12, passes through burner 12, and then from burner 12 flows to inlets 36 of fan 14.

Return airflow paths represented by arrows 86 can provide additional air to inlets 36 of fan 38. Each return airflow path 86 travels within a return air duct 38 from each of the return plenums 34 to one of the inlets 36 on either side of fan 14. As noted above, shroud 80 can operate as part of the return air duct 38, helping to direct air of the return airflow paths 86 into inlets 36 of fan 14. As discussed above, shroud 80 can include a central opening 82 (FIG. 7) providing a bearing cooling flow path to permit some cooler ambient air to additionally enter inlets 36 of fan 14 to flow over fan bearings 84 centrally located in the fan inlet 36. Thus, despite the fact that highly heated air flows into fan inlets 36 directly from burner 12 via burner airflow path, and return warm air flows into inlets 36 of fan 14 via return airflow paths 86, cool air can still flow over fan bearings 84 via central opening 82 in shroud 80.

The air from these three flow paths can be thoroughly mixed in fan 14, thereby outputting air that is of substantially uniform temperature. Fan output airflow paths represented by arrows 90 provide communication between outlet of fan 14 and each heat plenum 32. Fan outlet airflow paths 90 can be provided by a dual duct 92 arrangement as seen in FIG. 6.

Referring to FIG. 2, the airflow through grain columns of each grain flow path 16 is shown in relation to the left pair of grain flow paths 16. It should be understood, however, that the same airflow paths also flow through the other pair of grain columns within grain flow paths 16 in like manner during operation of grain dryer 10. Air first enters heat plenum 32 via fan outlet flow path 86.

From the lower portion of the heat plenum 32, air flows outwardly through the grain columns of lower portions 19 of adjacent grain flow paths 16 into the surrounding enclosures 40, 42 as represented by double headed arrow 45. In this case, the left outer enclosure 40 and the inner enclosure 42. Thus, a heat zone is provided in the grain columns of the lower portion 19 of the grain flow paths 16 adjacent heat plenum 32 due to heat airflow paths 45.

From the upper portion of the heat plenum 32, air flows into the upper portion 17 of the grain flow path 16 via inlet openings 89 associated with alternating rows of upper transverse diverters 88*a* (FIG. 9) as indicated by arrows 47. After flowing through the grain column as shown in FIG. 9, the air can then exit the grain dryer 10 through openings 89 associated with the interspersed alternating rows of upper grain diverters 88*b* as indicated by arrows 49. Thus, a pre-heat zone is provided in the grain columns of the upper portion 19 of the grain flow paths 16 adjacent heat plenum 32 due to preheat airflow paths 47.

The relationship between the mass or volume of grain and the total cross-sectional area of the openings (89 and 20) in the upper and lower sections (17 and 19, respectively) create a pressure drop ratio that is approximately 2:1 (upper section pressure drop:lower section pressure drop). Stated another way, the openings 89 and grain flow paths 16 are configured to distribute approximately twice the amount of air from the heat plenum 32 into the lower portion 19 than into the upper portion 17 of the grain flow path during operation.

The combination of lower airflow and greater grain mass or volume in the upper portion 17 of grain flow path 16 than in the lower portion 19, results in the grain being gently preheated in the preheat zone of the upper portion 17. The gentle heating of the grain in this pre-heat zone brings the moisture to the surface of the grain without causing it to be trapped within the grain. Likewise, this combination results in the grain being fully heated in the heat zone of the lower portion 19 to drive the moisture out of the grain without it being trapped therein.

Enclosures 40, 42 define portions of airflow paths 46, 48 causing the air to then flow again through one of the grain columns of a grain flow path 16 into the upper portion 17 or lower portion 19, respectively. In this way, air passes into the grain columns or grain flow path 16 twice before being exhausted or returned to fan 14 for recirculation.

For example, enclosures 40, 42 define portions of preheat airflow path 46 through a grain column from enclosures 40, 42 which exits to the atmosphere, for example, through into exhaust plenum 28. The air of preheat airflow path 46 is still warm. As a result of this warm airflow 46, an extended preheat zone is provided in the grain columns of grain flow paths 16 adjacent exhaust plenum 28. The preheat zone helps reduce thermal shock as the grain is being heated in grain dryer 10. Air in the exhaust plenum 28 exits the grain dryer through exhaust opening 30 in the back wall 94 (FIG. 1) of grain dryer 10.

Enclosures 40, 42 also define portions of temper airflow path 48 through a grain column of adjacent grain flow paths 16 from enclosures 40, 42 into return plenum 34. Air flowing through a grain column into return plenum 34 from enclosures 40, 42 into return plenum 34 is also still warm. This airflow occurs at an uppermost portion of the grain columns adjacent return plenum 34, providing a temper zone. The temper zone helps reduce thermal shock as the grain is being cooled in grain dryer 10.

A cooling zone is next created in grain columns adjacent below the temper zone as a result of ambient air being pulled into return plenum 34 below temper zone via cooling airflow path 50. In cooling zone, ambient air is pulled into return plenum 34 via cooling airflow path 50 through adjacent grain columns via corresponding openings 20. Air within return plenum 34 is pulled back into the fan 14 via return airflow path 86. Thus, return air plenum 34 can typically be at a negative pressure during operation.

As a result of the various airflow paths 45, 46, 47, 48 and 50 through grain columns of grain flow paths 16 defining central plenum 22, grain is first preheated in preheat zone as a result of airflow path 47. Then, as grain moves down grain flow paths 16, the grain is heated in heat zone as a result of airflow path 45. Continuing down grain flow paths 16, the grain is next subjected to a temper zone as a result of airflow path 48, below which airflow path 50 creates a cooling zone portion of grain columns in grain flow paths 16 Thus, the grain can be subjected to at least four different treatment zones as it flows down through each grain flow path 16.

Cooling airflow path 50, temper airflow path 48, or both, can pick up fines from the grain column and carry them into return plenum 34 and return airflow path 86 to fan 14. After passing through fan 14, any such fines are returned to the grain columns via return airflow paths 90 including fan output airflow paths 90. Thus, return airflow path 86 and fan output airflow path 90, including through fan 14, define a recirculating airflow path in which fines might possibly be present. Since the airflow path through burner 12 is positioned outside the recirculating airflow path, any fines picked up flow through the recirculating airflow path without passing through burner 12. As discussed above, only fresh ambient air flows through burner 12 on its way into the recirculating airflow path. Thus, there is no concern about igniting any fines pulled from a grain column.

Air flowing into the upper portion 17 of the grain column or grain flow path 16 from the central plenum 22 indicated by arrows 47 can pass through the grain as seen in FIG. 9 and then out to the atmosphere as indicated by arrows 49. Air entering via arrows 47 can also flow into exhaust plenum 28 and can exit grain dryer 10 to the atmosphere through exhaust opening 30 in a central location between the adjacent pairs of grain flow paths 16 defining exhaust plenum 28 above the central divider 24.

Various methods should be apparent from the above discussion and should be considered part of the disclosure. For example, some methods disclosed herein can involve providing various components of grain dryer 10 disclosed herein. Other methods disclosed herein can involve arranging or connecting various components as disclosed herein. Further methods disclosed herein can involve providing components to create or creating various airflow paths as disclosed herein. Additional methods disclosed herein can involve operating various components as disclosed herein. Providing various components to create the various treatment zones in a grain column are also methods disclosed herein. Moreover, combinations including various aspects of the disclosed methods, including those listed as examples above, are further methods disclosed herein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence of importance or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A continuous flow grain dryer comprising:

a pair of grain flow paths through which the grain flows downwardly under the influence of gravity in a grain column; each grain flow path being defined by a pair of longitudinally extending side walls and a pair of transversely extending end walls;

each grain flow path having an upper portion comprising:

a plurality of upper elongated grain diverters extending transversely across the grain flow path between opposing inner faces of the pair of longitudinally extending side walls;

an upper opening in the side walls associated with each upper grain diverter;

each grain flow path having a lower portion comprising:

a plurality of lower elongated grain diverters extending longitudinally along alternating sides of the grain flow path between opposing inner faces of the pair of end walls;

a longitudinally extending lower opening in the side walls associated with each lower grain diverter;

a central air plenum positioned between the pair of grain flow paths; and a divider separating the central air plenum into a positive pressure plenum and a negative pressure plenum;

wherein the upper portion of each grain flow path comprises a mixed flow dryer configuration, and wherein airflow passing from the positive pressure plenum through the upper portion of the pair of grain flow paths creates a preheat zone in the upper portion of the pair of grain flow paths during operation; and wherein the lower portion of each grain flow path comprises an undulating flow dryer configuration, and wherein airflow passing from the positive pressure plenum through the upper portion of the pair of grain flow path creates a heat zone in the pair of adjacent flow paths below the preheat zone during operation.

2. The continuous grain flow dryer of claim 1, further comprising an enclosure adjacent each opposite side of the pair of grain flow paths that extends to include a plurality of the upper openings and a plurality of the longitudinally extending lower openings, wherein air exiting the plurality of longitudinally extending lower openings enclosed by the enclosure is returned into the plurality of upper openings enclosed by the enclosure.

3. The continuous grain flow dryer of claim 2, wherein the plurality of upper openings comprises a first row of the upper openings associated with a first row of the upper grain diverters.

4. The continuous grain flow dryer of claim 1, wherein the upper portion of each grain flow path comprises a mixed flow dryer configuration.

5. The continuous grain flow dryer of claim 4, wherein, during operation, the upper portion of each grain flow path causes an upper portion pressure drop as airflow passes through the upper openings in a first of the pair of longitudinally extending side walls, through the grain flow path, and out the upper openings in a second of the pair of longitudinally extending side walls that is about two times that of a lower portion pressure drop as airflow passes through the lower openings in the first of the pair of longitudinally extending side walls, through the grain flow path, and out the lower openings in the second of the pair of longitudinally extending side walls and back again out of the lower openings in the first of the pair of longitudinally extending side walls.

6. The continuous grain flow dryer of claim 4, wherein a total cross sectional area of each of the upper and lower openings and a width of each of the upper and lower portions of each grain flow path are configured to cause about twice the volume of air to pass through grain in the lower portion as through grain in the upper portion during operation.

7. The continuous grain flow dryer of claim 1, wherein airflow passing from the first and second enclosures to the negative pressure plenum creates a temper zone in the pair of grain flow paths below the heat zone, and ambient airflow passing into the negative pressure plenum via the plurality of lower openings creates a cooling zone below the temper zone during operation.

8. The continuous grain flow dryer of claim 1, further comprising:

a recirculating airflow path from the negative pressure plenum through a fan and back to the heat plenum, wherein during operation, the return plenum is fed by airflow passing through grain columns in the pair of grain flow paths; and a burner outside the recirculating airflow path providing heated air to the fan via a burner airflow path that joins to the recirculating airflow path, wherein during operation, the burner is fed by ambient airflow from a burner inlet without any recirculating airflow passing through the burner.

9. A continuous flow grain dryer comprising:

a pair of grain flow paths through which the grain flows downwardly under the influence of gravity in a grain column; each grain flow path being defined by a pair of longitudinally extending side walls and a pair of transversely extending end walls;

each grain flow path having an upper portion comprising:

a plurality of upper elongated grain diverters extending transversely across the grain flow path between opposing inner faces of the pair of longitudinally extending side walls;

an upper opening in the side walls associated with each upper grain diverter;

each grain flow path having a lower portion comprising:

a plurality of lower elongated grain diverters extending longitudinally along alternating sides of the grain flow path between opposing inner faces of the pair of end walls;

a longitudinally extending lower opening in the side walls associated with each lower grain diverter;

wherein the upper elongated grain diverters are aligned substantially perpendicular in plan view to the longitudinally extending side walls, and wherein the lower elongated grain diverters are aligned substantially parallel in plan view to the longitudinally extending side walls;

a central air plenum positioned between the pair of grain flow paths; and a divider separating the central air plenum into a positive pressure plenum and a negative pressure plenum;

wherein the upper portion of each grain flow path comprises a mixed flow dryer configuration, and wherein airflow passing from the positive pressure plenum through the upper portion of the pair of grain flow paths creates a preheat zone in the upper portion of the pair of grain flow paths during operation; and wherein the lower portion of each grain flow path comprises an undulating flow dryer configuration, and wherein airflow passing from the positive pressure plenum through the upper portion of the pair of grain flow path creates a heat zone in the pair of adjacent flow paths below the preheat zone during operation.

10. The continuous grain flow dryer of claim 9, further comprising an enclosure adjacent each opposite side of the pair of grain flow paths that extends to include a plurality of the upper openings and a plurality of the longitudinally extending lower openings, wherein air exiting the plurality of longitudinally extending lower openings enclosed by the enclosure is returned into the plurality of upper openings by the enclosure.

11. The continuous grain flow dryer of claim 10, wherein the plurality of upper openings comprises a first row of the upper openings associated with a first row of the upper grain diverters.

12. The continuous grain flow dryer of claim 9, wherein the upper portion of each grain flow path comprises a mixed flow dryer configuration.

13. The continuous grain flow dryer of claim 12, wherein, during operation, the upper portion of each grain flow path causes an upper portion pressure drop as airflow passes through the upper openings in a first of the pair of longitudinally extending side walls, through the grain flow path, and out the upper openings in a second of the pair of longitudinally extending side walls that is about two times that of a lower portion pressure drop as airflow passes through the lower openings in the first of the pair of longitudinally extending side walls, through the grain flow path, and out the lower openings in the second of the pair of longitudinally extending side walls and back again out of the lower openings in the first of the pair of longitudinally extending side walls.

14. The continuous grain flow dryer of claim 12, wherein a total cross sectional area of each of the upper and lower openings and a width of each of the upper and lower portions of each grain flow path are configured to cause about twice the volume of air to pass through grain in the lower portion as through grain in the upper portion during operation.

15. The continuous grain flow dryer of claim 9, wherein airflow passing from the first and second enclosures to the negative pressure plenum creates a temper zone in the pair of grain flow paths below the heat zone, and ambient airflow passing into the negative pressure plenum via the plurality of lower openings creates a cooling zone below the temper zone during operation.

16. The continuous grain flow dryer of claim 9, further comprising:

a recirculating airflow path from the negative pressure plenum through a fan and back to the heat plenum, wherein during operation, the return plenum is fed by airflow passing through grain columns in the pair of adjacent grain flow paths; and a burner outside the recirculating airflow path providing heated air to the fan via a burner airflow path that joins to the recirculating airflow path, wherein during operation, the burner is fed by ambient airflow from a burner inlet without any recirculating airflow passing through the burner.

* * * * *